US006823706B1

(12) United States Patent
Kaneko et al.

(10) Patent No.: US 6,823,706 B1
(45) Date of Patent: Nov. 30, 2004

(54) STEEL WIRE AND METHOD OF MANUFACTURING THE SAME

(75) Inventors: Yoshikazu Kaneko, Kuroiso (JP); Naohiko Obana, Kuroiso (JP); Masuhiro Fujita, Kuroiso (JP); Hideki Masubuchi, Kuroiso (JP); Toshiyuki Kobayashi, Kkuroiso (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/424,300

(22) PCT Filed: May 20, 1998

(86) PCT No.: PCT/JP98/02198

§ 371 (c)(1),
(2), (4) Date: Mar. 13, 2000

(87) PCT Pub. No.: WO98/53134

PCT Pub. Date: Nov. 26, 1998

(30) Foreign Application Priority Data

May 21, 1997 (JP) ..... 9-131387

(51) Int. Cl.[7] ..... B21C 1/04

(52) U.S. Cl. ..... 72/278; 72/378; 148/500; 148/579; 148/595; 148/598; 148/612; 148/645; 428/606

(58) Field of Search ..... 72/278, 378, 160; 148/500, 579, 595, 598, 612, 645; 428/606

(56) References Cited

U.S. PATENT DOCUMENTS 1,824,568 A 9/1931 Pierce
4,756,151 A * 7/1988 Charvet ..... 57/213
4,960,473 A 10/1990 Kim et al.
5,888,321 A * 3/1999 Kazama et al. ..... 152/451
6,102,095 A * 8/2000 Obana et al. ..... 152/451

FOREIGN PATENT DOCUMENTS

| | | | |
|---|---|---|---|
| EP | 0 537 618 A1 | | 4/1993 |
| JP | 6-184966 | * | 7/1994 |
| JP | 7-197390 | * | 8/1995 |
| JP | 7-305285 | * | 11/1995 |
| JP | 08024938 A | | 1/1996 |
| JP | 08218282 A | | 8/1996 |
| JP | 8-260096 | * | 10/1996 |
| JP | 8-284082 | * | 10/1996 |

OTHER PUBLICATIONS

Patent Abstract of Japan, vol. 1996, No. 02 (Feb. 29, 1996) as it relates to JP 7–265936 A (Oct. 17, 1995) assigned to Nippon Steel Corp.

* cited by examiner

*Primary Examiner*—Elizabeth M. Cole
*Assistant Examiner*—Andrew Piziali
(74) *Attorney, Agent, or Firm*—Sughrue Mion, PLLC

(57) ABSTRACT

A steel wire, 0.10–0.40 mm in diameter, obtained by subjecting a high-carbon (0.70–0.90 wt. %) steel wire material to heat treatment and wire drawing, wherein its tensile strength and test values of special repeated torsional tests satisfy a predetermined relation; and a method of manufacturing the same. A high strength steel wire which has so high a ductility as to substantially prevent the wire from being broken even during wire twisting, and which rarely encounters a decrease in the ductility even after the wire has been subjected to age hardening by heating, is obtained, and a method of manufacturing the same is economical.

8 Claims, 3 Drawing Sheets

STEEL WIRE AND METHOD OF MANUFACTURING THE SAME

TECHNICAL FIELD

The present invention relates to a steel wire used for reinforcement of rubber articles or the like having high strength and excellent ductility and a method of manufacturing the same.

BACKGROUND ART

In a conventional manufacturing process for a steel wire used for reinforcement of rubber articles such as steel radial tires or high pressure hoses, a high carbon steel rod containing about 0.70~0.90% in weight of carbon is drawn to an intermediate diameter and subjected to a heat treatment and brass plating to form a steel wire material, and then the steel wire material is drawn to the final diameter. When the steel wire thus obtained is used for reinforcement of a rubber article, the steel wire is embedded in non-vulcanized rubber in a form of a single wire or a steel cord formed by a plurality of the steel wire twisted together, and then heated to achieve vulcanization of the rubber and adhesion between the steel wire and the rubber.

Recently, a steel wire of higher strength is strongly desired with growing demand for conservation of energy and natural resource. In order to produce a steel wire of higher strength by the conventional manufacturing process described above, it is necessary to increase the amount of drawing performed on the steel wire material. However, when the amount of drawing is increased, ductility of the steel wire is deteriorated to cause frequent wire breakage in processing or poor durability in use. And in some cases, deterioration of ductility particularly at the surface layer of the steel wire can be a ruling factor on possible amount of drawing or achievable strength. This phenomenon is due to the fact that the drawing strain can concentrate more easily at the surface layer than can at the internal portion of the steel wire, making the surface layer become unable to withstand further drawing earlier than the internal portion. Moreover, deterioration of ductility at the surface layer can be aggravated by age hardening or poor lubrication due to heat generated by friction with drawing die. In order to overcome such problems in ductility, some improvements in drawing technique have been proposed.

Among such improvements in drawing technique, one approach is to control age hardening of steel wire by suppression of heat generation during drawing. For example, JP-A 8-24938 discloses a manufacturing method of a high tensile strength steel wire having such ductility that the steel wire can be given a large amount of torsion until it breaks when the wire is twisted to one direction wherein drawing at the final die is carried out with control of heat generation by limitation of friction coefficient and application of a skin pass with reduction of 2~11%.

Further, JP-A 8-218282 discloses a high tensile steel wire having torque reduction ratio of less than or equal to 7% in a torsion-torque test in which a steel wire is twisted to one direction and then twisted to the opposite direction. As a manufacturing method of such a steel wire, JP-A 8-218282 also discloses a drawing method wherein (1) drawing resistance is reduced by using dies of shorter bearing, (2) skin pass is adopted for the final drawing using double die, (3) dies with sintered diamond nib are used at several passes located downstream in order to reduce drawing force, and (4) temperature of lubricating fluid is maintained low.

However, even though a steel wire of less age hardening degree can be produced, the above drawing methods do not give essential improvement as to the concentration of strain at the surface layer, rather, causing more concentration of strain at the surface layer in case of applying excessively low reduction per die. Therefore, good ductility of a steel wire shown immediately after drawing can be largely deteriorated by preforming in cabling or by progression of age hardening due to heating in rubber.

Conventionally, ductility of a steel wire has been evaluated by value of breaking torsion which is defined as an amount of unidirectional torsion applied to a steel wire until the steel wire is broken, or by considering both value of breaking torsion and form of fracture. Another evaluating method is adopted in JP-A 8-218282 wherein ductility of a steel wire is evaluated by torsion-torque curve obtained in a torsion test in which a steel wire is twisted in one direction for a certain number of turns and then twisted in the opposite direction until the steel wire is broken.

However, steel wires showing good results in above evaluating methods do not always maintain good ductility after preforming such as cabling or after heat aging followed by preforming, and improvement in durability of rubber articles reinforced by such steel wires is not assured.

Generally, in production of a steel cord for reinforcement of rubber articles, steel wires are preformed so as to have minimum radius of curvature ranging from about 10 to 150 times their diameter. Particularly, production of such steel cords listed below comprises such a severe preforming that a steel filament is preformed so as to have minimum radius of curvature ranging from about 10 to 60 times its diameter. Therefore, when a conventional steel wire is used as a filament of such steel cords, ductility is considerably deteriorated by the severe preforming and further deteriorated largely by heating in rubber.

(1) A steel cord having so-called "open structure" comprising largely preformed steel filaments.
(2) A steel cord comprising a steel filament preformed into a polygonal spiral shape or wavy shape.
(3) A steel cord of core and sheath structure having a core comprising a steel filament formed into a wavy shape.

Another approach for controlling the deterioration of ductility accompanying with increase in tensile strength is to make distribution of strain in a steel wire developed by drawing more uniform so as to control deterioration of ductility in the surface layer where the strain reaches maximum. For example, JP-A 7-305285 discloses a method for manufacturing a steel wire wherein:

(1) reduction of each die used for drawing where drawing strain $\epsilon$ is less than 0.75 is set within a range between $(22.67\ \epsilon+3)\%$ and 29%, wherein $\epsilon=2\ln(d_0/d)$, $d_0$ is diameter in mm of steel wire material before drawing, and d is diameter in mm of steel wire after passing the die,
(2) reduction of each die used for drawing where $\epsilon$ is not less than 0.75 and not more than 2.25 is set within a range between 20% and 29%; and
(3) reduction of each die used for drawing where $\epsilon$ is more than 2.25 is set within a range between $(-6.22\ \epsilon+43)\%$ and $(-5.56\ \epsilon+32.5)\%$.

By this method, substantial drawing strain at the surface area can be controlled, but controlling effect on age hardening due to heat generated by drawing is insufficient, and economical production becomes difficult with increasing drawing speed because of frequent wire breakage in cabling or drawing process.

In view of above problems of prior art, it is an object of the present invention to provide a steel wire having such a excellent ductility that the steel wire hardly breaks in cabling and little deteriorates by preforming or age hardening after preforming. And another object is to provide a method for economically manufacturing such a steel wire.

DISCLOSURE OF THE INVENTION

After various experiments and studies, the inventors found that very important points for achievement of above objects are;

(1) ductility of surface layer of a steel wire should be evaluated and regulated by a specially arranged repeated torsion test, and (2) optimization of reduction per die at the final die is necessary as well as uniform distribution of strain induced by drawing for economical manufacturing of such a steel wire.

The present invention has been done based on the important points mentioned above and includes following aspects in which [1]~[4] relate to a steel wire having excellent ductility which little deteriorates by preforming or by age hardening after preforming, and [5]~[7] relate to a method of manufacturing such a steel wire economically.

[1] A steel wire having a diameter ranging from 0.10 mm to 0.40 mm obtained by subjecting a high-carbon steel wire material having a carbon content ranging from 0.70% to 0.90% in weight to heat treatment and wire drawing, characterized in;

that tensile strength TS ($N/mm^2$) of the steel wire satisfies following formula $$TS \geqq 2250-1450 \log D \quad (1)$$

wherein D is the diameter of the steel wire in mm and log means common logarithm, and that repeated torsion value RT (turns/100D) of the steel wire, which is defined as sum of forward twisting and reverse twisting given until a crack is formed on a steel wire in a test wherein a steel wire is subjected to a repetition of forward twisting equivalent to 3 turns per 100D and reverse twisting to the original state, satisfies following formula.

$$\log RT \geqq 2-0.001\{TS-(2250-1450 \log D)\}. \quad (2)$$

[2] A steel wire having above characteristics wherein tensile strength TS ($N/mm^2$) satisfies following formula.

$$TS \geqq 2750-1450 \log D \quad (3)$$

[3] A steel wire of less concentration of strain at the surface layer having repeated torsion value RT not less than 60% of RT of the same steel wire the surface layer of which has been removed by the amount equivalent to 10% of total volume.

[4] A steel wire especially suitable for reinforcement of rubber articles and having above characteristics wherein breaking torsion value, which is defined as an amount of twisting to one direction subjected to a steel wire until the steel wire is broken, is not less than 20 turns per 100D when the steel wire has been given such a preforming that the steel wire has minimum radius of curvature of 10 to 60 times its diameter and embedded in rubber and taken out from the rubber after vulcanization.

[5] A method of manufacturing a steel wire having above characteristics by drawing a high-carbon steel wire material after heat treatment, characterized in that the drawing is carried out according to following conditions;

① reduction per die is set form (22.67 $\epsilon$+3)% to 29% for dies at which $\epsilon$ is less than 0.75, ② reduction per die is set from 20% to 29% for dies at which $\epsilon$ is not less than 0.75 and not more than 2.25, ③ reduction per die is set from (−5.56 $\epsilon$+32.5)% to (−6.22 $\epsilon$+43)% for dies at which $\epsilon$ is more than 2.25 except for the final die, ④ reduction per die is set from 4% to (−8.3 $\epsilon$+40.6)% for the final die, and ⑤ $\epsilon$ at the final die is set from 3.0 to 4.3, wherein $\epsilon$ is drawing strain expressed by a formula $\epsilon=2\ln(d_0/d)$ (4), $d_0$ is diameter of the steel wire material in mm before drawing, d is diameter of the steel wire in mm after passing through a die, and ln means natural logarithm.

[6] A method of manufacturing a steel wire which enables economical manufacturing of super high tensile steel wire, wherein $\epsilon$ at the final die is set from 3.5 to 4.2 in the method of manufacturing a steel wire described above.

[7] A method which makes above method of manufacturing a steel wire more effective, wherein a bending operation with tension is applied to the steel wire drawn through the final die.

PREFERRED EMBODIMENT FOR IMPLEMENTING THE INVENTION

Figure 1:
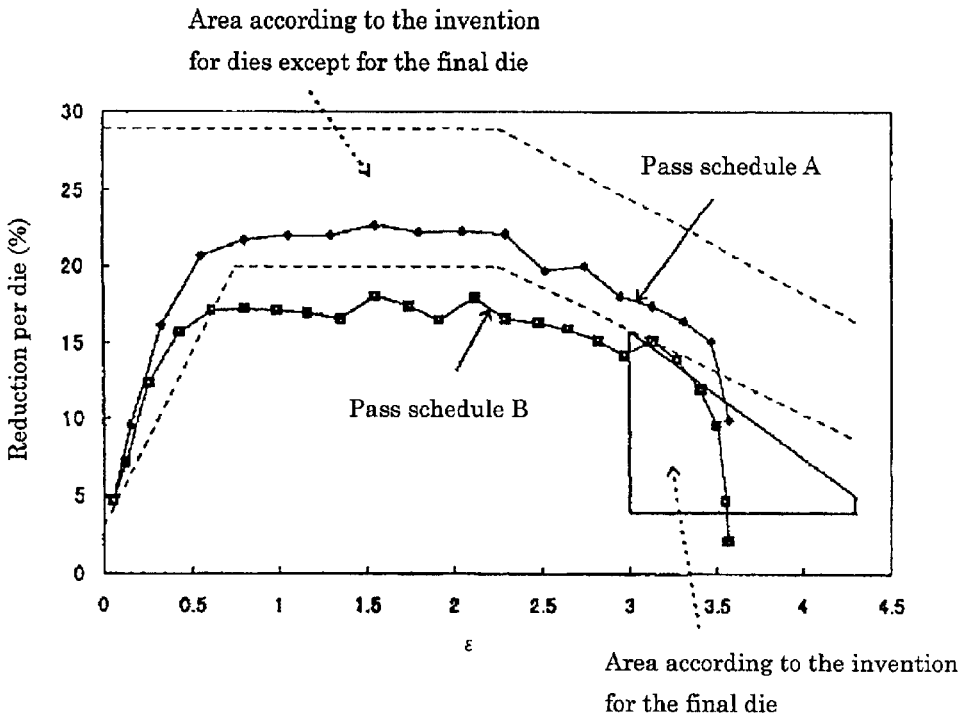
FIG. 1 is a graph showing relationship between $\epsilon$ and reduction per die for pass schedule A and B as well as area of reduction per die according to the present invention.

Following is a detailed explanation of repeated torsion test adopted in the present invention. In this test, a steel wire with its axis kept straight is subjected to a repetition of twisting equivalent to 3 turns per length of 100times its diameter to form a crack on the steel wire. In order to keep the axis of the steel wire straight during the test, the steel wire is stretched by small tension. The steel wire is twisted by predetermined number of turns $N_0$, and then returned to the original state by the same number of turns to the reverse direction. This cycle including one forward twisting and one reverse twisting is repeated to form a crack on the steel wire. Here, $N_0$ is a number of turns equivalent to 3 turns per length of 100 times the diameter of the steel wire and expressed by $N_0=3\times(L/100D)$, wherein L(mm) is length of the steel wire subjected to the twisting and D(mm) is diameter of the steel wire.

Repeated torsion value RT is sum of forward twisting and reverse twisting given until a crack is formed on the steel wire expressed by amount of turns per 100D and is calculated as follows. If a crack is formed at the time when the steel wire is turned $N_{f1}(\leqq N_0)$ times to the forward direction in the cycle next to n cycles of forward tuning of $N_0$ times and reverse turning, the repeated torsion value RT is calculated by following formula(5*a*).

$$RT=(2nN_0+N_{f1})/(L/100D) \quad (5a)$$

If a crack is formed at the time when the steel wire is turned $N_{f2}(\leqq N_0)$ times to the reverse direction after forward turning of $N_0$ times in the cycle next to n cycles of forward tuning of $N_0$ times and reverse turning, the repeated torsion value RT is calculated by following formula(**5*b***).

$$RT=\{(2n+1)N_0+N_{f2})\}/(L/100D) \quad (5b)$$

Preferable conditions for above-described repeated torsion test are as follows.

(1) Length of steel wire subjected to twisting is about 50 mm.

(2) Tension applied to the axial direction of steel wire is about 1.0 kg when diameter of steel wire is not more than 0.25 mm, or about 1.5 kg when the diameter is more than 0.25 mm.

(3) Turning rate is about 30 turns per minute.

(4) Detection of crack formation is done by detection of acoustic emission (A.E.) wave accompanying with crack formation. A.E. wave is an elastic wave emitted by release of strain energy when a solid body is distorted or fractured. By electrical detection of A.E. using A.E. sensor, formation of micro cracks prior to breaking of steel wire can be exactly detected and accurate evaluation can be done.

In the present invention, above-described repeated torsion value is adopted for a parameter of ductility of steel wire because the inventors discovered that a steel wire having high repeated torsion value not only has high ductility when it is subjected to the test but also little deteriorates in ductility by preforming such as cabling or by age hardening.

Generally, saving of ductility becomes more difficult by increasing tensile strength or diameter of steel wire. Therefore, conventional steel wires do not satisfy following formula (1) and (2) simultaneously.

$$TS \geqq 2250-1450 \log D \quad (1)$$

$$\log RT \geqq 2-0.001\{TS-(2250-1450 \log D)\} \quad (2)$$

However, a steel wire according to the invention satisfies both formula (1) and (2) having high strength and excellent ductility even when the steel wire is actually used as reinforcement of rubber articles or the like.

As to strength of a steel wire, a steel wire having tensile strength TS(N/mm$^2$) satisfying following formula (1) is suitable for reinforcement of rubber articles.

$$TS \geqq 2250-1450 \log D \quad (1)$$

But it is preferable that following formula (6) is satisfied.

$$TS \geqq 2500-1450 \log D \quad (6)$$

Further, remarkable effect on weight reduction of rubber articles can be obtained when following formula (3) is satisfied.

$$TS \geqq 2750-1450 \log D \quad (3)$$

In order to realize such a steel wire having high repeated torsion value, it is desirable that ductility of surface layer of a steel wire is not far from that of internal part of the steel wire where decrease in ductility is less progressed by drawing. Comparison of ductility between surface layer and internal part of a steel wire can be done by comparison of repeated torsion value between a steel wire with its surface layer having been removed and the same steel wire with its surface layer not removed. It is preferable that repeated torsion value of a steel wire with its surface layer not removed is not less than 60% of that of the same wire with its surface layer having been removed.

Because a steel wire according to the present invention is little deteriorated in ductility even when it is aged by heating after severe preforming, it can be advantageously used as a filament of previously referred steel cords in which steel filaments are severely preformed to have minimum radius of curvature ranging from about 10 to 60 times the diameter. In this case, it is preferable to use a steel wire having breaking torsion value of not less than 20 turns/100D in a conventional torsion test when the steel wire has been given such a preforming that the steel wire has minimum radius of curvature of 10 to 60 times its diameter and embedded in rubber and taken out from the rubber after vulcanization. Then, ductility of the steel wire in a rubber article is certainly assured.

When a steel wire of the invention is used for reinforcement of a rubber article, a coating having adhesive property for rubber can be formed on its surface. As a means for formation of such a coating, conventional means such as drawing a steel wire material after heat treatment and brass-plating can be adopted.

Next, a method of manufacturing a steel wire according to the present invention will be explained.

In order to produce a steel wire having tensile strength TS and repeated torsion value RT both according to the present invention, it is essential to control concentration of drawing strain at the surface layer of the steel wire. In general, distribution of drawing strain becomes more uniform and the concentration of drawing strain at the surface of a steel wire is more relieved by using smaller die approach angle and/or larger reduction per die. However, in actual operations, it is necessary to set up drawing conditions considering processing accuracy of die, efficiency of lubrication, breaking load of the steel wire, etc. That is, if die approach angle is set too small or reduction per die is set too large, drawing strain at the surface is rather increased caused by difficulty of lubrication, or frequency of wire breakage is increased thereby making it difficult to produce a steel wire with high productivity.

Therefore, in the method of manufacturing a steel wire according to the present invention, drawing is carried out on a heat-treated steel wire material according to the following conditions to produce a steel wire;

① reduction per die is set form (22.67 $\epsilon$+3)% to 29% for dies at which $\epsilon$ is less than 0.75, ② reduction per die is set from 20% to 29% for dies at which $\epsilon$ is not less than 0.75 and not more than 2.25, ③ reduction per die is set from (−5.56 $\epsilon$+32.5)% to (−6.22 $\epsilon$+43)% for dies at which $\epsilon$ is more than 2.25 except for the final die, ④ reduction per die is set from 4% to (−8.3 $\epsilon$+40.6)% for the final die, and ⑤ $\epsilon$ at the final die is set from 3.0 to 4.3, wherein $\epsilon$ is drawing strain expressed by a formula $\epsilon=2\ln(d_0/d)$, $d_0$ is diameter of the steel wire material before drawing, d is diameter of the steel wire after passing through a die, and ln means natural logarithm. In other words, though drawing conditions disclosed in JP-A 7-305285 are adopted for dies except for the final die, it is necessary to set reduction of the final die within a range which is lower than that disclosed in the same.

The reason why reduction of the final die should be set within above-mentioned range is as follows. In conventional wet drawing machines, drawing at dies except for the final die is carried out in liquid lubricant, but the steel wire having passed through the final die is not immersed in liquid lubricant. Therefore, if reduction of the final die is set according to the same condition as that of dies disposed upstream, deterioration of ductility by age hardening becomes severe because of high temperature of the steel wire having passed through the final die This problem is aggravated by increase of drawing speed. In order to solve the problem, the inventors examined and investigated concerning the reduction of the final die and found that the deterioration of ductility by age hardening can be controlled keeping concentration of drawing strain at the surface of the steel wire within proper degree, by setting the reduction of the final die within a range of 4% to (−8.3 ϵ+40.6)%. If reduction of the final die is less than 4%, the wire may have good ductility immediately after drawing but largely deteriorated by age hardening when the steel wire is heated later. So, the lower limit is set 4%. The upper limit is set (−8.3 ϵ+40.6)% in order to control heat generation even when flow stress is increased by increase of ϵ so as to suppress damage on the surface of the steel wire caused by deterioration of ductility of the steel wire or poor lubrication. Satisfying this condition, increase in drawing speed or production of a super high tensile steel wire becomes easier compared with prior art.

Total drawing amount, which is value of ϵ at the final die, should be from 3.0 to 4.3 and is selected according to strength of the steel wire to be obtained. Particularly, this invention is suitable for production of super high tensile steel wire which needs severe drawing with ϵ more than or equal to 3.5, or more than or equal to 4.0. The upper limit 4.3 is set because control of deterioration of ductility becomes insufficient if ϵ exceeds 4.3. Preferable value for the upper limit is 4.2.

Moreover, as a means for further improvement of ductility of a steel wire, a bending operation with tension can be adopted on a drawn steel wire so as to decrease drawing strain at the surface layer of the steel wire. This operation also decreases residual stress at the surface layer of the steel wire, and a steel wire having excellent durability as a reinforcement of rubber articles can be produced. Because a steel wire according to the invention has sufficient ductility and is hardly broken even when a sever bending is given, such a bending operation can be easily adopted.

As to geometry of dies to be used, ordinary dies used for drawing of steel wire materials, e.g. dies having approach angle from 8 to 12 degrees and bearing length of 0.3D to 0.6D, can be used. Also, material of dies is not limited to such as sintered diamond. And dies of cheaper materials such as cemented carbide can be used. As to the steel wire material to be drawn, it is preferable to use a high carbon steel wire material having good uniformity produced by a preferable heat treatment in which decarburization is controlled and uniform pearlite, containing less foreign phases such as primary cementite, primary ferrite or bainite, is formed.

Hereafter, the present invention will be explained based on some examples.

EXAMPLE 1, 2 AND COMPARATIVE EXAMPLE 1, 2

A high carbon steel wire rod of about 5.5 mm in diameter containing about 0.82% in weight of carbon was drawn by dry drawing until its diameter reached about 1.67 mm. And then, patenting and brass-plating was done to obtain a brass-plated steel wire material. The brass-plated steel wire material had metallic structure of nearly uniform pearlite and its tensile strength TS was about 1250N/mm$^2$ measured by tensile test according to JIS (Japanese Industrial Standard) G3510.

The brass-plated steel wire material was drawn to produce steel wires having diameter of 0.28 mm on four drawing conditions shown in Table 1 which are combinations of two kinds of pass schedule and whether bending operation after drawing is done or not. Table 2 shows detail of two pass schedules A and B, and FIG. 1 shows the relationship between ϵ and reduction per die of respective pass schedules. As FIG. 1 shows, pass schedule A satisfies the limitation of the present invention and pass schedule B is a comparative example in which reduction per die at each die is set lower to decrease heat generation.

Figure 4:
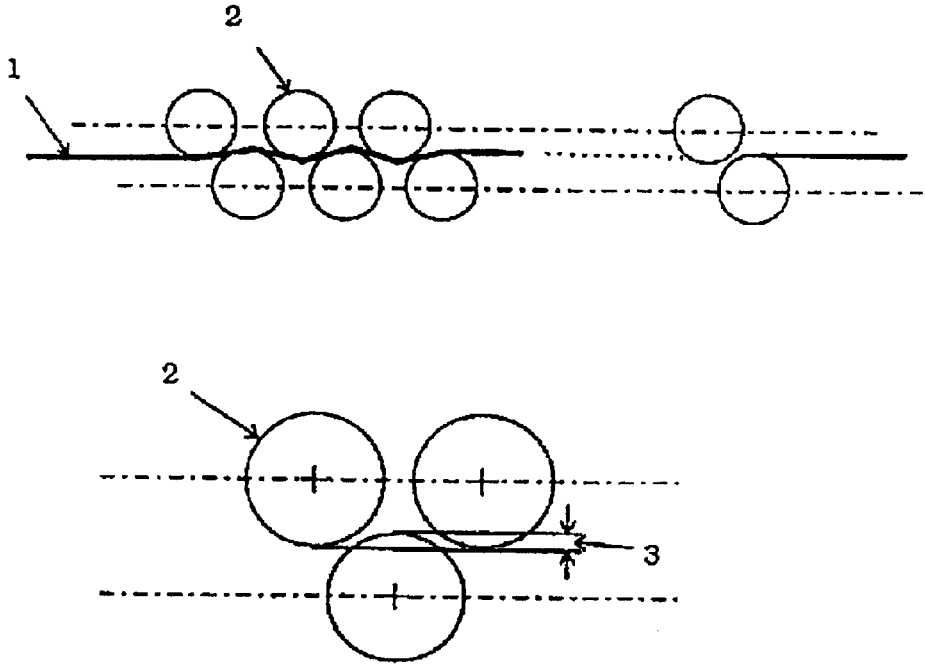
FIG. 4 is an illustration of a bending apparatus.

In the drawing, a slip-type multi-pass wet drawing machine was used with cemented carbide dies having approach angle of about 12 degrees and bearing length of about 0.5 D. The bending operation after drawing was done with tension of about 2 kg by using an apparatus shown in FIG. 4 in which number of rollers 2 was nine, diameter of rollers 2 was 16 mm and engagement 3 was 6 mm.

TABLE 1

| | pass schedule | bending operation |
|---|---|---|
| Example 1 | A | no |
| Example 2 | A | yes |
| Comparative example 1 | B | no |
| Comparative example 2 | B | yes |

TABLE 2

| | pass schedule A | | | Pass schedule B | | |
|---|---|---|---|---|---|---|
| die No. | hole diameter (mm) | ϵ | reduction per die (%) | hole diameter (mm) | ϵ | reduction per die (%) |
| 1 | 1.630 | 0.048 | 4.7 | 1.630 | 0.048 | 4.7 |
| 2 | 1.550 | 0.149 | 9.6 | 1.570 | 0.123 | 7.2 |
| 3 | 1.420 | 0.324 | 16.1 | 1.470 | 0.255 | 12.3 |
| 4 | 1.265 | 0.556 | 20.6 | 1.350 | 0.425 | 15.7 |
| 5 | 1.120 | 0.799 | 21.6 | 1.230 | 0.612 | 17.0 |
| 6 | 0.990 | 1.046 | 21.9 | 1.120 | 0.799 | 17.1 |
| 7 | 0.875 | 1.293 | 21.9 | 1.020 | 0.986 | 17.1 |
| 8 | 0.770 | 1.548 | 22.6 | 0.930 | 1.171 | 16.9 |
| 9 | 0.680 | 1.797 | 22.0 | 0.850 | 1.351 | 16.5 |
| 10 | 0.600 | 2.047 | 22.1 | 0.770 | 1.548 | 17.9 |
| 11 | 0.530 | 2.295 | 22.0 | 0.700 | 1.739 | 17.4 |
| 12 | 0.475 | 2.515 | 19.7 | 0.640 | 1.918 | 16.4 |
| 13 | 0.425 | 2.737 | 19.9 | 0.580 | 2.115 | 17.9 |
| 14 | 0.385 | 2.935 | 17.9 | 0.530 | 2.295 | 16.5 |
| 15 | 0.350 | 3.125 | 17.4 | 0.485 | 2.473 | 16.3 |
| 16 | 0.320 | 3.305 | 16.4 | 0.445 | 2.645 | 15.8 |
| 17 | 0.295 | 3.467 | 15.0 | 0.410 | 2.809 | 15.1 |
| 18 | 0.280 | 3.572 | 9.9 | 0.380 | 2.961 | 14.1 |
| 19 | | | | 0.350 | 3.125 | 15.2 |
| 20 | | | | 0.325 | 3.274 | 13.8 |
| 21 | | | | 0.305 | 3.401 | 11.9 |
| 22 | | | | 0.290 | 3.501 | 9.6 |
| 23 | | | | 0.283 | 3.550 | 4.8 |
| 24 | | | | 0.280 | 3.572 | 2.1 |

For the steel wires produced by the respective conditions, tensile strength TS and repeated torsion value RT were measured according to the following conditions.

Tensile strength TS was measured by tensile test according to JIS G3510.

Figure 5:
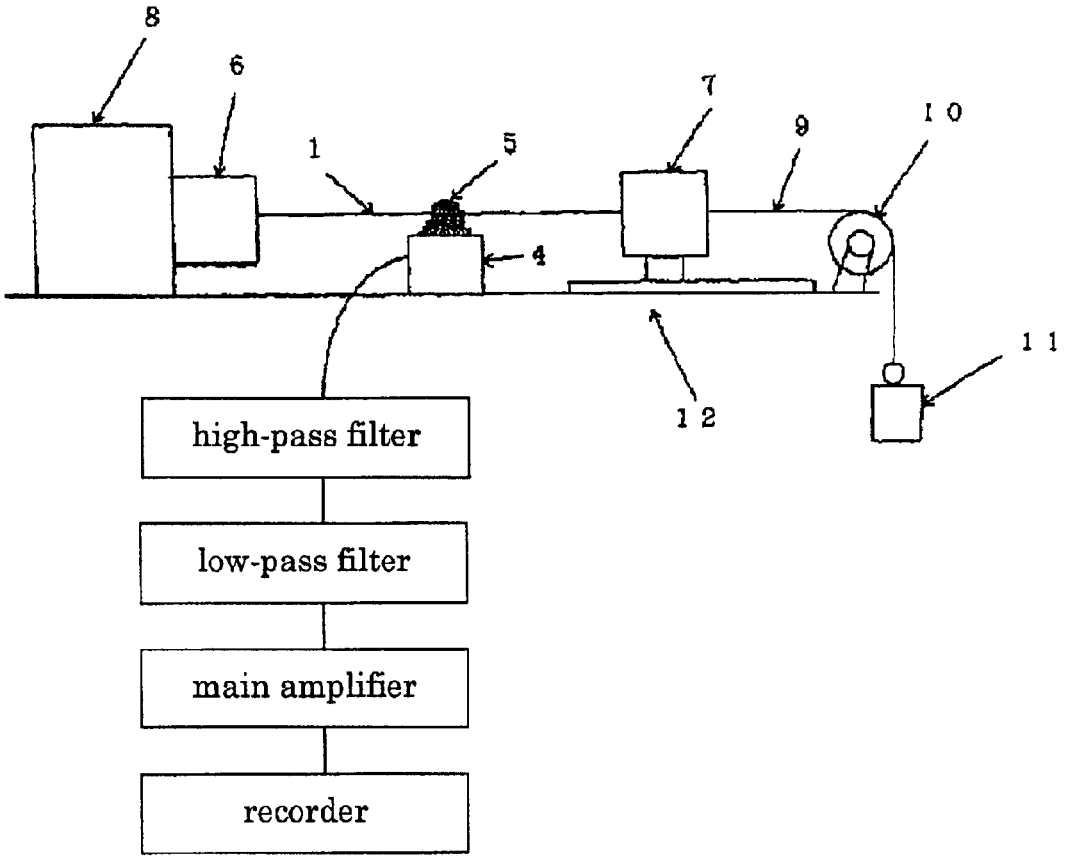
FIG. 5 is an illustration of an equipment used for repeated torsion test.

Repeated torsion value RT was measured by using an apparatus shown in FIG. 5. In FIG. 5, number 6 indicates a rotating chuck which holds one end of a steel wire 1 and is rotated around the axis of the steel wire 1 by a driving means 8 which is fixed on a base 12. Number 7 indicates a fixed chuck which holds the other end of the steel wire 1 so as not to rotate. The fixed chuck 7 is supported on the base 12 and is movable to the axial direction of the steel wire 1. A wire 9 carrying a weight 11 for giving tension to the steel wire 1 is connected to the fixed chuck 7 at the side opposite to the steel wire 1 through a pulley 10.

In the measurement of repeated torsion value RT, respective ends of the steel wire 1 were held by the rotating chuck 6 and the fixed chuck 8 and length of the steel wire 1 between the rotating chuck 6 and the fixed chuck 7 was adjusted so as to make the length of the steel wire to be twisted be 50 mm. The weight 11 of about 1.5 kg was used. The number of turns $N_0$ equivalent to 3 turns per length of 100 times the diameter of the steel wire is 5.36 turns according to the formula $N_0=3\times(L/100D)$. The rotating chuck 6 was driven by the driving means 8 so that the rotating chuck 6 made repetition of 5.36 clockwise turns and 5.36 counterclockwise turns to return to the original position, thereby giving the steel wire 1 repetition of twisting equivalent to 3 turns per length of 100 times the diameter of the steel wire. The rotating speed of the rotating chuck 6 was about 30 turns per minute.

Formation of a crack was detected by A.E. sensor 4 disposed under the steel wire 1 as shown in FIG. 5. In order to detect A.E. wave effectively, grease 5 was put on the A.E. sensor 4 with the steel wire 1 piercing through it. The A.E. sensor used had a built-in preamplifier with gain of about 40 dB and frequency range of 90 to 300 kHz and was connected to a main amplifier with gain of 60 dB through a high-pass filter of 50 kHz and a low-pass filter of 1000 kHz, and the output of the main amplifier was displayed on a recorder. While the output of the main amplifier caused by noise was ± several tens $\mu$V output of ± several hundreds $\mu$V was obtained when a crack was formed so that time of crack formation was clearly determined.

The results are listed below in Table 3.

TABLE 3

| | tensile strength ($N/mm^2$) | Repeated torsion value (turns/100 D) |
|---|---|---|
| Example 1 | 3350 | 57 |
| Example 2 | 3346 | 74 |
| Comparative example 1 | 3332 | 15 |
| Comparative example 2 | 3322 | 21 |

Figure 3:
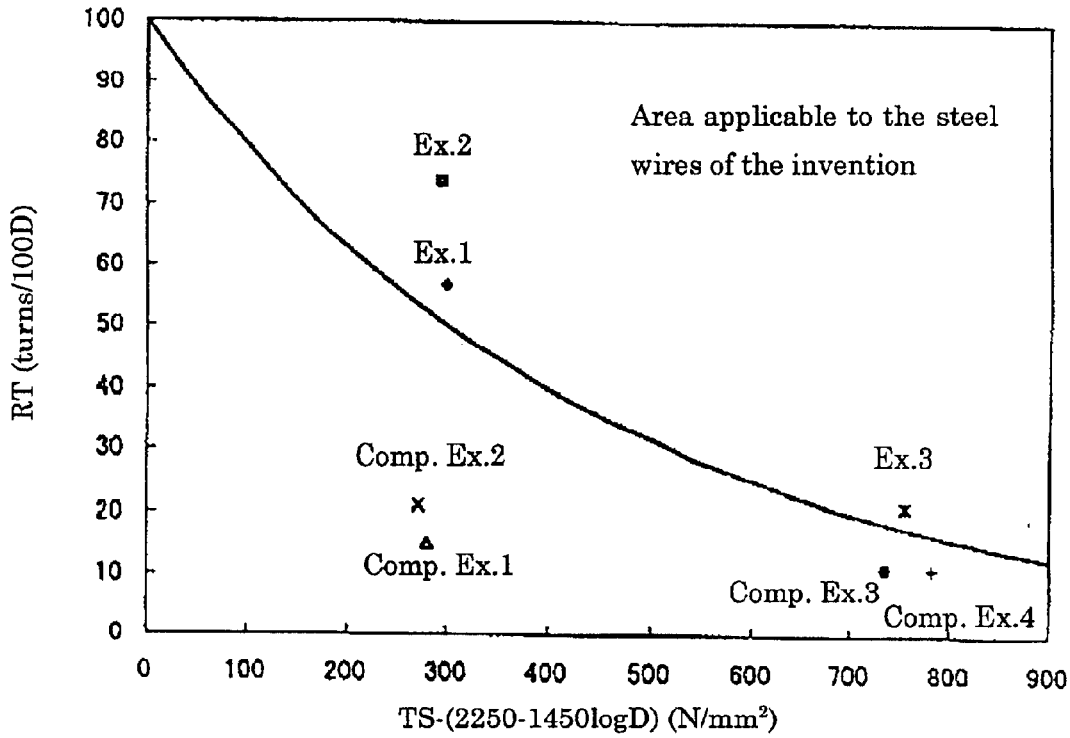
FIG. 3 is a graph showing relationship between tensile strength and repeated torsion value for steel wires of Examples and Comparative examples as well as area of repeated torsion value according to the present invention.

As shown in Table 3, steel wires of Example 1 and 2 had tensile strength equivalent to that of Comparative example 1 and 2, and had remarkably higher repeated torsion value compared with that of Comparative example 1 and 2. The steel wire of Example 2, to which a bending operation had been given, showed still higher repeated torsion value compared with that of Example 1. Relationship between tensile strength and repeated torsion value for each steel wire is shown in FIG. 3 accompanied with results of Example 3 and Comparative example 3, 4 which will be explained later. As shown in FIG. 3, steel wires of Example 1 and 2 satisfy limitation of repeated torsion value according to the invention while those of Comparative example 1 and 2 do not satisfy the limitation.

Further, in order to evaluate distribution of drawing strain in the steel wires, relationship between volume of removed surface layer and repeated torsion value was investigated with removing the surface layer by dissolution in nitric acid solution. The results are shown in Table 4. As shown in Table 4, repeated torsion values of steel wires of Example 1 and 2 with the surface layer not removed (ratio of removed surface layer=0 vol. %)were not less than 60% of that with the surface layer equivalent to 10% by volume having been removed. Among the steel wires of Examples, the steel wire of Example 2, on which a bending operation after drawing was performed, showed especially high value. On the other hand, repeated torsion values of the steel wires of Comparative example 1 and 2 with the surface layer not removed (ratio of removed surface layer=0 vol. %) were much lower than 60% of that with the surface layer equivalent to 10% by volume having been removed.

TABLE 4

| ratio of removed surface layer (%) | repeated torsion value (turns/100 D) Example 1 | Example 2 | Comparative example 1 | Comparative example 2 |
|---|---|---|---|---|
| 0 | 57 (71) | 74 (91) | 15 (19) | 21 (28) |
| 1 | 61 (75) | 75 (93) | 20 (25) | 22 (30) |
| 5 | 75 (94) | 78 (96) | 59 (73) | 59 (80) |
| 10 | 80 (100) | 81 (100) | 75 (100) | 74 (100) |

*Numbers in parentheses indicate relative value wherein value for ratio of removed surface layer = 10% is set 100 for each case.

Further, relationship between volume of removed surface layer and F.W.H.M. (Full Width Half Maximum) of X-ray diffraction peak for ferrite 211 at the surface emerged after removal of surface layer was investigated so as to make comparison of distribution of drawing strain in ferrite. The result is listed in Table 5. As shown in Table 5, F.W.H.M. for ferrite 211 of steel wires of Example 1 and 2 with the surface layer not removed (ratio of removed surface layer=0 vol. %) were smaller than those of Comparative example 1 and 2, and difference against F.W.H.M. for ferrite 211 with the surface layer having been removed were smaller. Further, F.W.H.M. for ferrite 211 of the steel wire of Example 2, on which a bending operation after drawing was carried out, with the surface layer not removed (ratio of removed surface layer=0 vol. %) was still smaller than that of Example 1, and difference against F.W.H.M. for ferrite 211 with the surface layer having been removed was still smaller, too. Therefore, it can be considered that distribution of drawing strain in ferrite was made more uniform with less concentration of drawing strain at the surface layer owing to a manufacturing method according to the present invention and further improved by bending operation.

Measurement of F.W.H.M. for ferrite 211 was done according to the condition shown in Table 6 by using a microfocus X-ray diffractometer equipped with P.S.P.C. (Position Sensitive Photo Counter) type X-ray detector. And the value of F.W.H.M. is F.W.H.M. of diffraction peak formed by K $\alpha$ 1 spectrum separated by calculation.

TABLE 5

| ratio of removed surface layer (%) | F.W.H.M. of X-ray diffraction peak for ferrite 211 (degree) Example 1 | Example 2 | Comparative example 1 | Comparative example 2 |
|---|---|---|---|---|
| 0 | 1.08 | 0.94 | 1.29 | 1.24 |
| 1 | 1.00 | 0.91 | 1.26 | 1.24 |
| 5 | 0.90 | 0.89 | 0.98 | 0.99 |
| 10 | 0.88 | 0.88 | 0.91 | 0.92 |

TABLE 6

| | |
|---|---|
| target | Cobalt |
| acceleration voltage | 40 kV |
| current | 100 mA |
| diameter of collimator | 100 $\mu$m |
| measurement time | 2000 seconds |

Further, in order to estimate ductility in use for reinforcement of rubber articles, breaking torsion value (amount of twisting to one direction subjected to a steel wire until the steel wire is broken) before and after heat aging for each steel wire was measured after forming into a wave shape having pitch of 4.5 mm and amplitude of 0.46 mm. This measurement was done by using an apparatus shown in FIG. 5 according to the following condition and rotating the rotating chuck 6 to one direction until the steel wire was broken.

twisted length of steel wire: 50 mm axial tension: about 1.5 kg turning rate: about 30 turns per minute In addition, breaking torsion value before and after heat aging for each steel wire without forming was measured by same way. These results are shown in Table 7. Heat aging was carried out by heating steel wires in a oven at 145° C. for 40 minutes. As shown in Table 7, repeated torsion values for steel wires of Comparative example 1 and 2 without forming and heat aging were equivalent to that of Example 1 and 2, however, they were considerably reduced by either wave forming or heat aging or both, falling into less than 20 turns per 100D. On the other hand, repeated torsion values for steel wires of Example 1 and 2 were less reduced by either wave forming or heat aging or both, maintaining more than 20 turns per 100D. Particularly, repeated torsion value for the steel wire of Example 2, on which bending operation after drawing was performed, was little reduced by either wave forming or heat aging or both.

TABLE 7

| | | repeated torsion value (turns/100 D) | | | |
|---|---|---|---|---|---|
| wave forming | heat aging | Example 1 | Example 2 | Comparative example 1 | Comparative example 2 |
| no | no | 33 | 34 | 31 | 34 |
| | yes | 30 | 34 | 11 | 15 |
| yes | no | 27 | 33 | 3 | 3 |
| | yes | 25 | 34 | 2 | 3 |

Further, steel cords having a construction of core formed by wavy filaments and a sheath shown in Table 8 were produced using each kind of steel wires for filaments of one steel cord, and they were embedded in rubber sheets and vulcanized at 145° C. for 40 minutes. After that, the steel cords were taken out from rubber and decomposed into separate filaments and repeated torsion value for each filament was measured. As a result, repeated torsion values for steel wires of Example 1 and 2 were more than 20 turns per 100D while those of Comparative example 1 and 2 were less than 20 turns per 100D, showing a result similar to the case with wave forming and heat aging shown in Table 7.

TABLE 8

| | | Forming | |
|---|---|---|---|
| | number of filaments | Shape | minimum radius of curvature (mm) |
| core | 1 | wave with amplitude of 0.46 mm and pitch of 4.5 mm | about 4 |
| sheath | 6 | spiral with amplitude of 0.92 mm and pitch of 14 mm | about 16 |

EXAMPLE 3, COMPARATIVE EXAMPLE 3 and 2

A high carbon steel wire rod of about 5.5 mm in diameter containing about 0.82% in weight of carbon was drawn by dry drawing until its diameter reached about 1.53 mm. And then, patenting and brass-plating was done to obtain a brass-plated steel wire material. The brass-plated steel wire material had metallic structure of nearly uniform pearlite and its tensile strength TS was about 1250N/mm$^2$.

Figure 2:
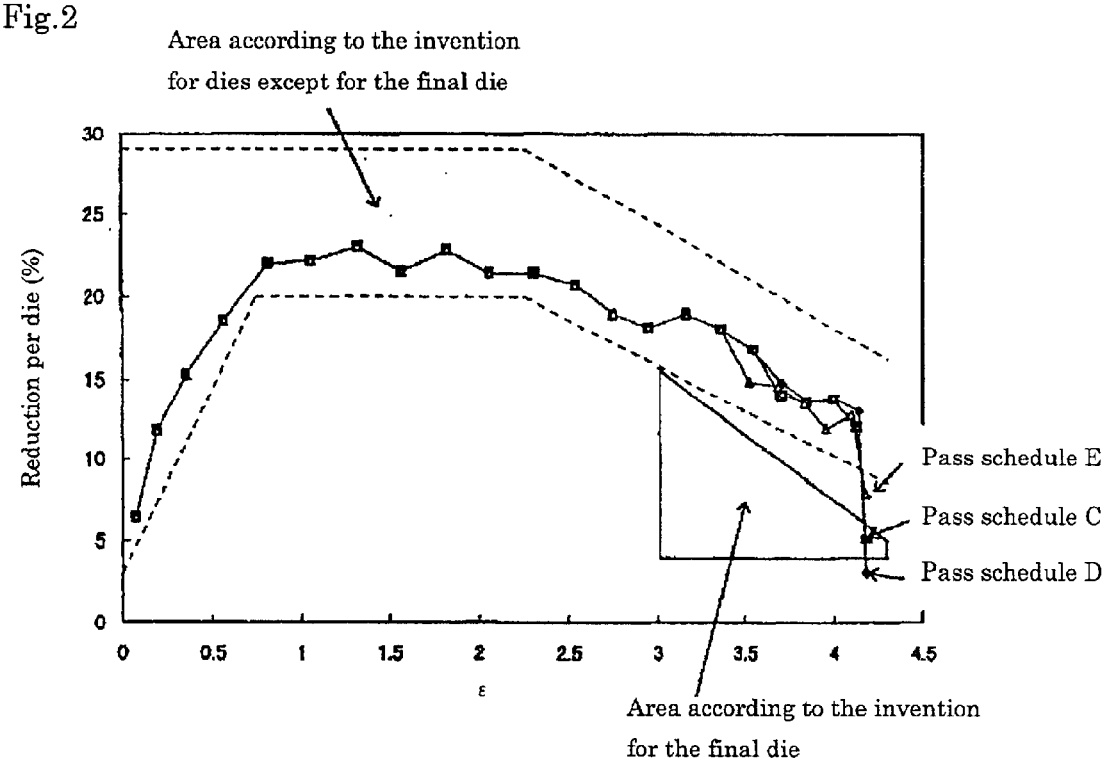
FIG. 2 is a graph showing relationship between $\epsilon$ and reduction per die for pass schedule C, D and B as well as area of reduction per die according to the present invention.

The brass-plated steel wire material was drawn to produce steel wires having diameter of 0.19 mm on three drawing conditions shown in Table 9. Table 10 shows detail of three pass schedules C, D and E, and FIG. 2 shows relationship between $\epsilon$ and reduction per die of respective pass schedules. As FIG. 2 shows, pass schedule C satisfies the limitation of the present invention. Pass schedule D is a Comparative example wherein reduction per die except for the final die satisfies the limitation of the present invention but excessively low at the final die. And pass schedule E is another Comparative example wherein reduction per die except for the final die satisfies the limitation of the present invention but excessively high at the final die.

In the drawing, a slip-type multi-pass wet drawing machine was used with cemented carbide dies having approach angle of about 9 degrees and bearing length of about 0.5 D. The bending operation after drawing was done with tension of about 2 kg by using an apparatus shown in FIG. 4 in which number of rollers 2 was twenty, diameter of rollers 2 was 12 mm and engagement 3 was about 3 mm.

TABLE 9

| | pass schedule | bending operation |
|---|---|---|
| Example 3 | C | yes |
| Comparative example 3 | D | yes |
| Comparative example 4 | E | yes |

TABLE 10

| | pass schedule C | | | pass schedule D | | | pass schedule E | | |
|---|---|---|---|---|---|---|---|---|---|
| die No. | hole diameter (mm) | $\epsilon$ | reduction per die (%) | hole diameter (mm) | $\epsilon$ | reduction per die (%) | hole diameter (mm) | $\epsilon$ | reduction per die (%) |
| 1 | 1.480 | 0.066 | 6.4 | 1.480 | 0.066 | 6.4 | 1.480 | 0.066 | 6.4 |
| 2 | 1.390 | 0.192 | 11.8 | 1.390 | 0.192 | 11.8 | 1.390 | 0.192 | 11.8 |
| 3 | 1.280 | 0.357 | 15.2 | 1.280 | 0.357 | 15.2 | 1.280 | 0.357 | 15.2 |
| 4 | 1.155 | 0.562 | 18.6 | 1.155 | 0.562 | 18.6 | 1.155 | 0.562 | 18.6 |
| 5 | 1.020 | 0.811 | 22.0 | 1.020 | 0.811 | 22.0 | 1.020 | 0.811 | 22.0 |
| 6 | 0.900 | 1.061 | 22.1 | 0.900 | 1.061 | 22.1 | 0.900 | 1.061 | 22.1 |
| 7 | 0.790 | 1.322 | 23.0 | 0.790 | 1.322 | 23.0 | 0.790 | 1.322 | 23.0 |
| 8 | 0.700 | 1.564 | 21.5 | 0.700 | 1.564 | 21.5 | 0.700 | 1.564 | 21.5 |
| 9 | 0.615 | 1.823 | 22.8 | 0.615 | 1.823 | 22.8 | 0.615 | 1.823 | 22.8 |

TABLE 10-continued

| | pass schedule C | | | pass schedule D | | | pass schedule E | | |
|---|---|---|---|---|---|---|---|---|---|
| die No. | hole diameter (mm) | ϵ | reduction per die (%) | hole diameter (mm) | ϵ | reduction per die (%) | hole diameter (mm) | ϵ | reduction per die (%) |
| 10 | 0.545 | 2.064 | 21.5 | 0.545 | 2.064 | 21.5 | 0.545 | 2.064 | 21.5 |
| 11 | 0.483 | 2.306 | 21.5 | 0.483 | 2.306 | 21.5 | 0.483 | 2.306 | 21.5 |
| 12 | 0.430 | 2.538 | 20.7 | 0.430 | 2.538 | 20.7 | 0.430 | 2.538 | 20.7 |
| 13 | 0.387 | 2.749 | 19.0 | 0.387 | 2.749 | 19.0 | 0.387 | 2.749 | 19.0 |
| 14 | 0.350 | 2.950 | 18.2 | 0.350 | 2.950 | 18.2 | 0.350 | 2.950 | 18.2 |
| 15 | 0.315 | 3.161 | 19.0 | 0.315 | 3.161 | 19.0 | 0.315 | 3.161 | 19.0 |
| 16 | 0.285 | 3.361 | 18.1 | 0.285 | 3.361 | 18.1 | 0.285 | 3.361 | 18.1 |
| 17 | 0.260 | 3.545 | 16.8 | 0.260 | 3.545 | 16.8 | 0.263 | 3.522 | 14.8 |
| 18 | 0.241 | 3.696 | 14.1 | 0.240 | 3.705 | 14.8 | 0.243 | 3.680 | 14.6 |
| 19 | 0.224 | 3.843 | 13.6 | 0.223 | 3.852 | 13.7 | 0.226 | 3.825 | 13.5 |
| 20 | 0.208 | 3.991 | 13.8 | 0.207 | 4.001 | 13.8 | 0.212 | 3.953 | 12.0 |
| 21 | 0.195 | 4.120 | 12.1 | 0.193 | 4.141 | 13.1 | 0.198 | 4.090 | 12.8 |
| 22 | 0.190 | 4.172 | 5.1 | 0.190 | 4.172 | 3.0 | 0.190 | 4.172 | 7.9 |

For the steel wires produced by the respective conditions, tensile strength TS, repeated torsion value RT and F.W.H.M. of X-ray diffraction peak for ferrite 211 were measured. Measuring conditions for tensile strength TS and F.W.H.M. for ferrite 211 were the same as those adopted for Example 1. Repeated torsion value was measured with $N_0$=7.89 and using weight 11 of about 1.0 kg, other conditions being same as those adopted for Example 1. The results are shown in Table 11. As shown in Table 11, steel wire of Example 3, wherein reduction per die at the final die was within the proper range, had remarkably higher repeated torsion value compared with that of Comparative example 3 and 4, with tensile strength equivalent to that of Comparative example 1 and 2. Moreover, F.W.H.M. for ferrite 211 at the surface of steel wire of Example 3 was smaller than that of Comparative example 3 and 4. Relationship between tensile strength and repeated torsion value for each steel wire is shown in FIG. 3 accompanied with results of Example 1, 2 and Comparative example 1, 2 explained before. As shown in FIG. 3, the steel wire of Example 3 satisfies limitation of repeated torsion value according to the invention while those of Comparative example 3 and 4 do not satisfy the limitation.

In drawing with the conditions according to Comparative example 3 and 4, some wire breakages were occurred when the wire passed the bending rollers. But no wire breakage was occurred in drawing with the condition according to Example 3.

TABLE 11

| | tensile strength ($N/mm^2$) | repeated torsion value (turns/100 D) | F.W.H.M of ferrite 211 (degree) |
|---|---|---|---|
| Example 3 | 4050 | 21 | 1.45 |
| Comparative example 3 | 4031 | 11 | 1.48 |
| Comparative example 4 | 4078 | 11 | 1.55 |

INDUSTRIAL APPLICABILITY

As described above, a steel wire according to the present invention has both high strength and excellent ductility which is little deteriorated even when it is subjected to a preforming and/or heat aging. Therefore, the steel wire shows excellent reinforcing effect and durability when it is used for reinforcement of rubber articles such as a filament of a steel cord for a tire. By adopting a method of manufacturing a steel wire according to the present invention, a steel wire having such a excellent property can be manufactured economically without deterioration of productivity by wire breakage of poor lubrication.

What is claimed is:

1. A method of manufacturing a steel wire having a diameter ranging from 0.10 mm to 0.40 mm obtained by subjecting a high-carbon steel wire material having a carbon content ranging from 0.70% to 0.90% in weight to heat treatment and wire drawing, characterized in;

that tensile strength TS ($N/mm^2$) of the steel wire satisfies following formula, $$TS \geqq 2250-1450 \log D$$

wherein D is the diameter of the steel wire in mm and log means common logarithm, and that repeated torsion value RT (turns/100D) of the steel wire, which is defined as sum of forward twisting and reverse twisting given until a crack is formed on a steel wire in a test wherein a steel wire is subjected to a repetition of forward twisting equivalent to 3 turns per 100D and reverse twisting to the original state with the axis of the steel wire kept straight, satisfies following formula, $$\log RT \geqq 2-0.001\{TS-(2250-1450 \log D)\}$$

which comprises a step of drawing a high-carbon steel wire material after heat treatment, characterized in that the step of drawing is carried out according to following conditions;

①reduction per die is set from (22.67 ϵ+3)% to 29% for dies at which E is less than 0.75, ②reduction per die is set from 20% to 29% for dies at which ϵ is not less than 0.75 and not more than 2.25, ③reduction per die is set from (−5.56 ϵ+32.5)% to (−6.22 ϵ+43)% for dies at which ϵ is more than 2.25 except for the final die, ④reduction per die is set from 4% to (−8.3 ϵ+40.6)% for the final die, and ⑤ϵ at the final die is set from 3.0 to 4.3, wherein ϵ is drawing strain expressed by a formula $\epsilon=2\ln(d_0/d)$, $d_0$ is diameter of the steel wire material in mm before drawing, d is diameter of the steel wire in mm after passing through a die, and ln means natural logarithm.

2. A method of manufacturing a steel wire comprising; a wire diameter ranging from 0.10 mm to 0.40 mm obtained by subjecting a high-carbon steel wire material having a carbon content ranging from 0.70% to 0.90% in weight to heat treatment and wire drawing, characterized in;

a tensile strength TS ($N/mm^2$) of the steel wire satisfies following formula, $$TS \geqq 2250-1450 \log D$$

wherein D is the diameter of the steel wire in mm and log means common logarithm, and that repeated torsion value RT (turns/100D) of the steel wire, which is defined as sum of forward twisting and reverse twisting given until a crack is formed on a steel wire in a test wherein a steel wire is subjected to a repetition of forward twisting equivalent to 3 turns per 100D and reverse twisting to the original state with the axis of the steel wire kept straight, satisfies following formula $\log RT \geqq 2-0.001\ \{TS-(2250-1450 \log D)\}$, said method comprising the steps of heat treating drawing a high-carbon steel wire material after heat treatment, wherein the step of drawing is carried out according to following conditions;

1. reduction per die is set from $(22.67\ \epsilon+3)\%$ to 29% for dies at which $\epsilon$ is less than 0.75,
2. reduction per die is set from 20% to 29% for dies at which $\epsilon$ is not less than 0.75 and not more than 2.25,
3. reduction per dies is set from $(-5.56\ \epsilon 32.5)\%$ to $(-6.22\ \epsilon+43)\%$ for dies at which $\epsilon$ is more than 2.25 except for the final die,
4. reduction per die is set from 4% to $(8.3\ \epsilon+40.6)\%$ for the final die, and
5. $\epsilon$ at the final die is set from 3.0 to 4.3, wherein $\epsilon$ is drawing strain expressed by a formula $\epsilon=2\ln(d_0/d)$, $d_0$ is diameter of the steel wire material in mm before drawing, d is diameter of the steel wire in mm after passing through a die, and ln means natural logarithm.

3. A method of manufacturing a steel wire according to claim 2, wherein $\epsilon$ at the final die is set from 3.5 to 4.2.

4. A method of manufacturing a steel wire according to claim 2, wherein a bending operation with tension is applied to the steel wire drawn through the final die.

5. A steel wire comprising wire diameter ranging from 0.10 mm to 0.40 mm obtained by subjecting a high-carbon steel wire material having a carbon content ranging from 0.70% to 0.90% in weight to heat treatment and wire drawing, the steel wire manufactured by drawing a high-carbon steel wire material after heat treatment, wherein the drawing is carried out according to following condition;

1. reduction per die is set from $(22.67\ \epsilon+3)\%$ to 29% for dies at which $\epsilon$ is less than 0.75,
2. reduction per die is set from 20% to 29% for dies at which $\epsilon$ is not less than 0.75 and not more than 2.25,
3. reduction per dies is set from $(-5.56\ \epsilon+32.5)\%$ to $(-6.22\ \epsilon+43)\%$ for dies at which $\epsilon$ is more than 2.25 except for the final die,
4. reduction per die is set from 4% to $(8.3\ \epsilon+40.6)\%$ for the final die, and
5. $\epsilon$ at the final die is set from 3.0 to 4.3, wherein $\epsilon$ is drawing strain expressed by a formula $\epsilon=2\ln(d_0/d)$, $d_0$ is diameter of the steel wire material in mm before drawing, d is diameter of the steel wire in mm after passing through a die, and ln means natural logarithm and the tensile strength TS ($N/mm^2$) of the steel wire satisfies following formula, $$TS \geqq 2250-1450 \log D$$

wherein D is the diameter of the steel wire in mm and log means common logarithm, and that repeated torsion value RT (turns/100D) of the steel wire, which is defined as sum of forward twisting and reverse twisting given until a crack is formed on a steel wire in a test wherein a steel wire is subjected to a repetition of forward twisting equivalent to 3 turns per 100D and reverse twisting to the original state with the axis of the steel wire kept straight, satisfies following formula, $$\log RT \geqq 2-0.001\{TS-(2250-1450 \log D)\}.$$

6. A steel wire according to claim 5, having tensile strength TS ($N/mm^2$) satisfying following formula $$TS \geqq 2750-1450 \log D.$$

7. A steel wire according to claim 6, having repeated torsion value RT not less that 60% of RT of the same steel wire the surface layer of which has been removed by the amount equivalent to 10% of total volume.

8. A steel wire according to claim 5, having breaking torsion value, which is defined as an amount of twisting to one direction subjected to a steel wire until the steel wire is broken, not less than 20 turns per 100D when the steel wire has been given such a preforming that the steel wire has minimum radius of curvature of 10 to 60 times its diameter and embedded in rubber and taken out from the rubber after vulcanization.

* * * * *